US005251726A

United States Patent [19]

de Jong

[11] Patent Number: 5,251,726

[45] Date of Patent: Oct. 12, 1993

[54] TOE GUARD FOR AN ELEVATOR

[75] Inventor: Johannes de Jong, Jarvenpaa, Finland

[73] Assignee: Kone Elevator GmbH, Baar, Switzerland

[21] Appl. No.: 892,314

[22] Filed: Jun. 2, 1992

[30] Foreign Application Priority Data

Jun. 6, 1991 [FI] Finland ..... 912719

[51] Int. Cl.[5] ..... B66B 9/00

[52] U.S. Cl. ..... 187/1 R; 187/62

[58] Field of Search ..... 187/1 R, 62, 67, 98, 187/DIG. 1

[56] References Cited

U.S. PATENT DOCUMENTS 3,945,468 3/1976 Miura et al. ..... 187/1 R
5,018,602 5/1991 Salmon et al. ..... 187/1 R
5,080,003 1/1992 Kappeler ..... 187/1 R X

FOREIGN PATENT DOCUMENTS 0418511 3/1991 European Pat. Off. .
52-20545 2/1977 Japan ..... 187/1 R
2-231386 9/1990 Japan ..... 187/1 R
3-158377 8/1991 Japan ..... 187/1 R
1481619 8/1977 United Kingdom .

*Primary Examiner*—Robert P. Olszewski
*Assistant Examiner*—Dean A. Reichard
*Attorney, Agent, or Firm*—Jacobson, Price, Holman & Stern

[57] ABSTRACT

A toe guard for an elevator is disclosed, at least part of which consists of a structure penetrable to air flow, thus diminishing the tendency of the toe guard to increase the air flow in the space between the front wall of the elevator car and the shaft wall.

6 Claims, 2 Drawing Sheets

TOE GUARD FOR AN ELEVATOR

FIELD OF THE INVENTION

The present invention concerns a toe guard for an elevator.

BACKGROUND TO THE INVENTION

An elevator car is provided with a toe guard, which is a downward extension of the front wall, i.e. the wall containing the door. The toe guard consists of a plate-like element whose lower part diverges slightly inwards into the elevator shaft from the direction of the front wall, and a supporting structure designed to increase the rigidity of the toe guard. The function of the toe guard is to ensure safe exit of passengers from the elevator car in case it stops between floors e.g. due to a power failure.

A problem with the conventional toe guard is that, especially in the case of fast elevators, when the elevator car is travelling downwards, the toe guard with its inclined shape acts as a booster which strengthens the air current in the space between the front wall of the elevator car and the shaft wall. The velocity of this air current increases faster than that of the elevator car and generates a disturbing noise that penetrates into the passenger space of the elevator car. A low noise level in the passenger space is considered to be one of the most important aspects of passenger comfort. To reduce the noise level, fast elevators are often provided with sound insulations, but it is relatively difficult to damp the noise generated by the air current between the shaft wall and the front wall of the car. This is due to the structure of the car doors, e.g. because the doors are not completely air-tight.

SUMMARY OF THE INVENTION

An object of the present invention is to achieve a new type of toe guard designed to substantially solve the problem described above. According to the present invention, there is provided a toe guard for an elevator, which is a downward extension of the front wall of the elevator car, wherein at least part of the toe guard is penetrable to air flow.

As compared to previously known techniques, the invention provides the following advantages:

The air current directed by the toe guard into the gap between the elevator car front wall and the shaft wall is reduced, thereby reducing the noise generated by the current.

The pressure difference across the toe guard is reduced, reducing its tendency to vibrate.

Since less air is forced into the gap between the car and the shaft wall opposite to the car door, the pressure in the gap is lower and therefore the force applied to the elevator car by this pressure is reduced, thus also reducing the offset-type load on the guides.

Although the primary function of the invention is to reduce the pressure of the air damned in below the toe guard during descent which increases the air current between the car front wall and the shaft wall, the invention also reduces the air current during ascent because the suction at the trailing edge is reduced.

BRIEF DESCRIPTION OF THE DRAWINGS

The invention is described in more detail by referring to the attached drawings, in which.

DETAILED DESCRIPTION OF A PREFERRED EMBODIMENT

Figure 1:
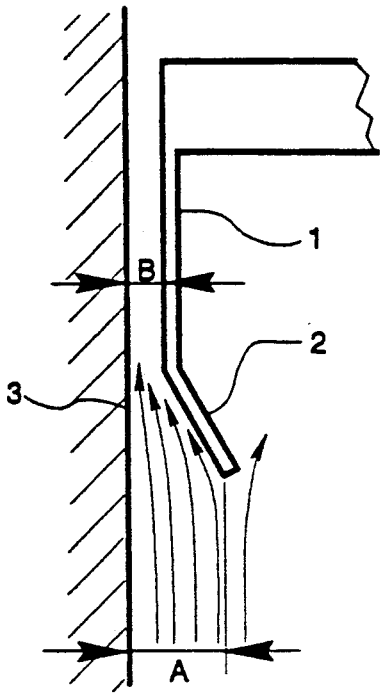
Fig. 1 Prior Art
FIG. 1 presents a previously known toe guard.

The conventional toe guard 1 shown in FIG. 1 is implemented as a downward extension of the front wall of the elevator car and forms, between its lower part 2 and the shaft wall 3, a cavity which opens in the downward direction. During down-travel of the elevator car, this cavity crowds the air from width A into width B. The packing of the air current is represented by arrows. Since the air flows from a larger cross-sectional area into a narrower area, the velocity of the flow in the narrower cross-sectional area must be higher in order to maintain the same volume flow. The high flow rate generates a disturbing noise which reaches the passenger space of the elevator. The amplitude of the noise increases clearly faster than the flow rate, so the velocity of the air current is a critical factor affecting the travelling comfort provided by an elevator car. When the elevator is moving upwards, the cavity formed by the toe guard creates a suction, which also increases the air flow between the shaft wall 3 and the front wall of the elevator car. The increase in the flow is smaller than during descent, however.

Figure 2:
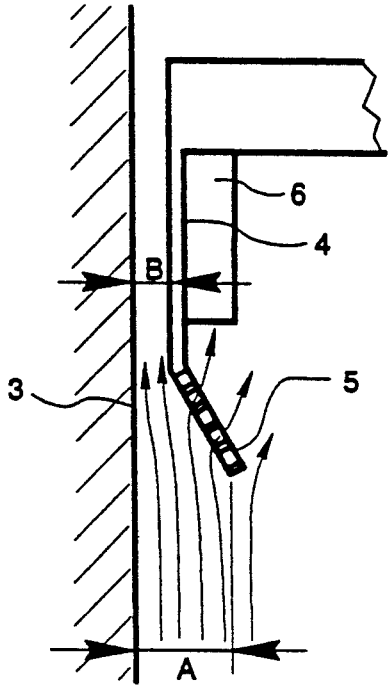
FIG. 2 presents a lateral view of a toe guard according to an embodiment of the invention.
Figure 3:
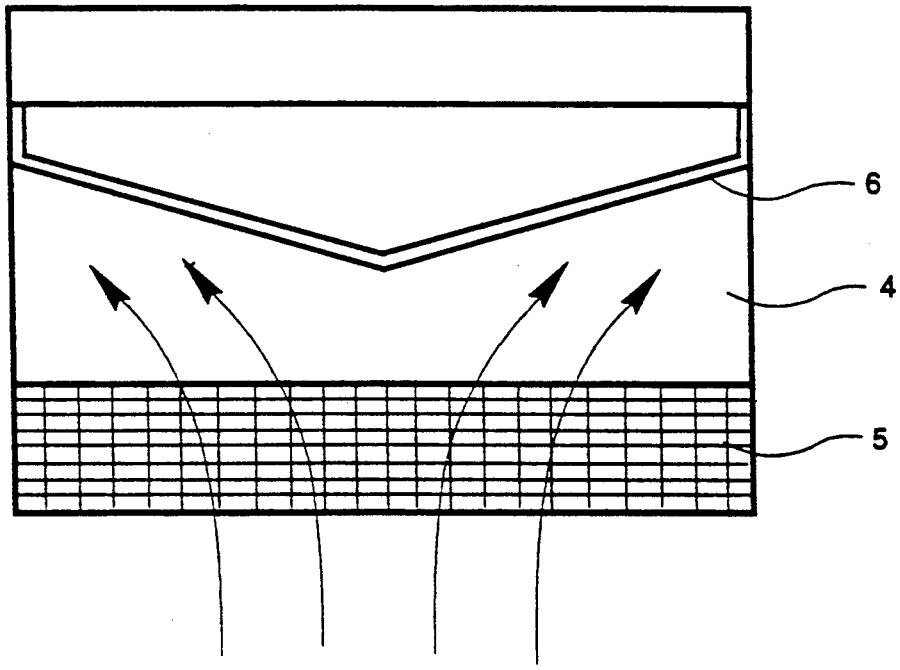
FIG. 3 presents the toe guard of FIG. 2 as seen from the shaft.

FIG. 2 is a simplified illustration of the toe guard 4 according to an embodiment of the invention. The lower part 5 of the toe guard is of a construction penetrable to air. In this case, part of the air entering the cavity A flows through the lower part 5, thus reducing the volume flow through width B. To prevent the air from being packed below the car, the toe guard is provided with a V-shaped air guide which quickly directs the air to the sides of the car. The air flow is represented by arrows. Correspondingly, when the elevator is moving upwards, the air flows in the opposite direction. FIG. 3 presents the same toe guard as seen from the shaft. The flow of the air passing through the lower part 5 of the toe guard to the air guide 6 and further to the sides of the car is represented by arrows.

Figure 4:
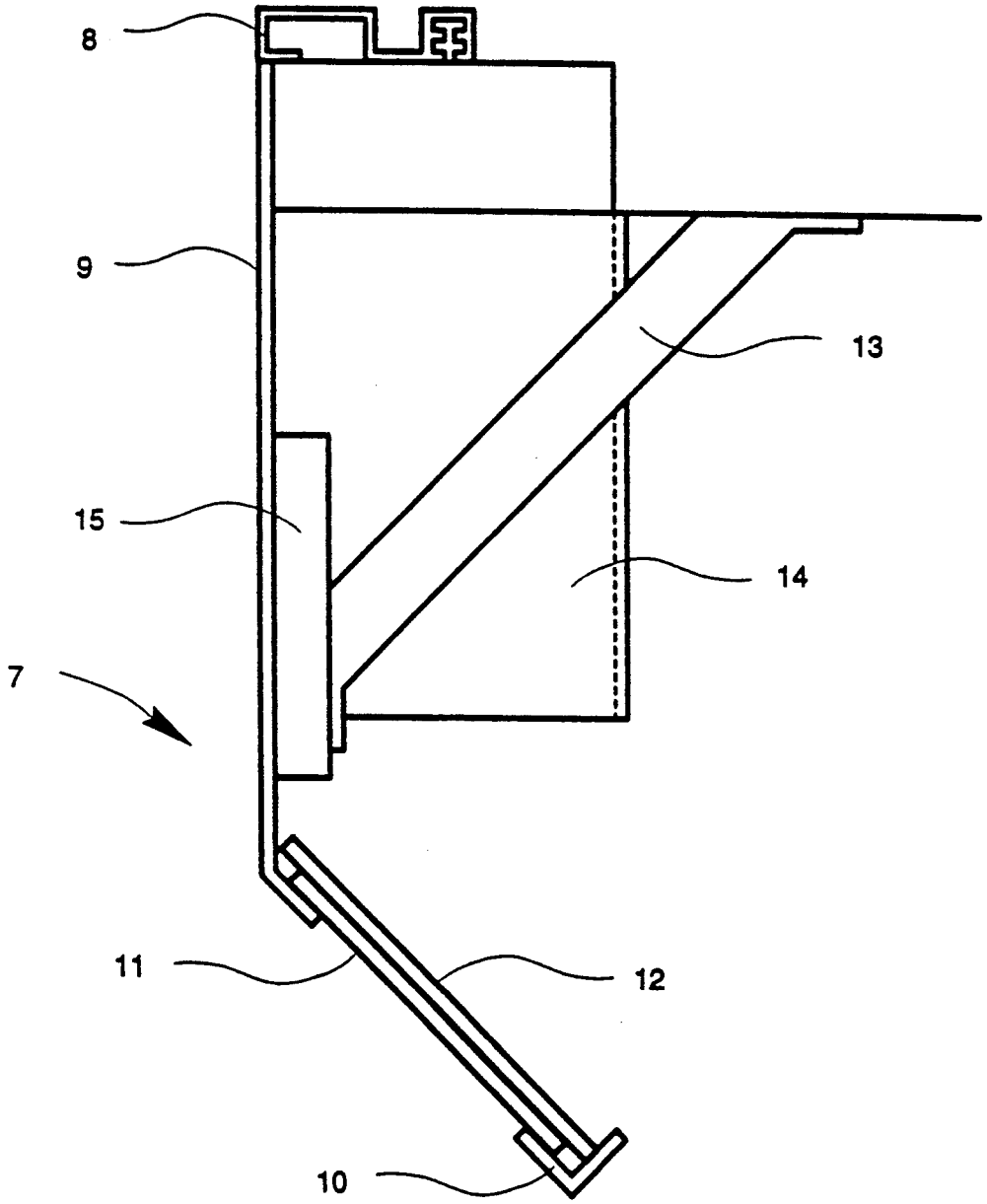
FIG. 4 presents a more detailed view of a toe guard according to an embodiment of the invention.

An advantageous toe guard consists of separate plate parts and supporting elements suitably connected. FIG. 4 shows a possible implementation in a lateral view. The toe guard consists of a plate part 9 extending downwards from the threshold 8 of the elevator car, and a frame 10 provided in its lower part. In this case the plate part 9 and the frame 10 are made of one piece. The frame 10 has been produced by bending the edges of the common blank of the parts and making cut-outs in it as appropriate. The frame 10 accommodates a network 11, which is held in place by means of a mounting element 12 provided with cut-outs corresponding to the frame. The toe guard is fixed to the lower part of the elevator car by means of a bracing structure 13 designed to receive any horizontal forces that may be applied to the toe guard. On that side of the toe guard which faces the elevator shaft there is a plough-type flow guide 14 which, being of a more streamlined shape than the bottom of the elevator car, directs the air flow to the sides of the car, thus reducing the pressure of the air congested under the car. Providing the toe guard plate with reinforcements 15 allows a relatively thin plate to be used. The parts can be joined together in any suitable manner, which is not described here. In addition to its lower part, the toe guard may be provided with further cut-outs to distribute the air pressure between the opposite sides of the plate.

It will be apparent to a person skilled in the art that different embodiments of the invention are not restricted to the examples described above, but that they may instead be varied within the scope of the following claims. For example, instead of a network it is possible to use a grating, or the toe guard plate can be provided with perforations, in which case no separate part penetrable to air will be needed. Similarly, the air flow can be directed to the sides of the car e.g. by means of vanes instead of a plough-type structure, or by appropriately shaping the lower part of the car. The elements directing the air flow to the sides, whether plough-type or some other type of elements, can be integrated with the reinforcements or bracing elements of the toe guard.

I claim:

1. A toe guard for an elevator car, said toe guard comprising a downward extension of the front wall of said elevator car, wherein at least part of the toe guard is inclined away from an adjacent wall of an elevator shaft and provided with a plurality of passages formed therein to permit passage of air therethrough.

2. A toe guard according to claim 1, wherein said toe guard includes at least one element designed to guide air flow.

3. A toe guard according to claim 1, wherein the part of said toe guard having said plurality of passages is the lower part of the toe guard.

4. A toe guard according to claim 1, wherein the part having said plurality of passages is composed of a network or grating.

5. A toe guard according to claim 1, wherein the toe guard comprises a front plate having in its lower part a frame accommodating the part having said plurality of passages, a bracing structure securing the toe guard to a bottom part of the elevator car, and a plough-type air flow guide.

6. A toe guard according to claim 5, wherein the air flow guide also acts as a reinforcement and bracing structure of the toe guard.

* * * * *